US006896050B2

(12) United States Patent
Biglin, Jr. et al.

(10) Patent No.: US 6,896,050 B2
(45) Date of Patent: May 24, 2005

(54) LATCHING SYSTEM FOR MAINTAINING POSITION OF COMPONENT WITHIN A DOWNHOLE DRILL STRING SECTION

(75) Inventors: Denis P. Biglin, Jr., Glastonbury, CT (US); Daniel E. Burgess, Portland, CT (US); Carl Allison Perry, Middletown, CT (US); Thomas Floyd Rzasa, Rocky Hill, CT (US); Ronald E. Seppa, Marlborough, CT (US); William E. Turner, Durham, CT (US)

(73) Assignee: PS Technology, Inc., Cromwell, CT (US)

( * ) Notice: Subject to any disclaimer, the term of this patent is extended or adjusted under 35 U.S.C. 154(b) by 82 days.

(21) Appl. No.: 10/439,078

(22) Filed: May 15, 2003

(65) Prior Publication Data

US 2004/0226749 A1 Nov. 18, 2004

(51) Int. Cl.[7] ..... E21B 23/02
(52) U.S. Cl. ..... 166/117.6; 166/98
(58) Field of Search ..... 166/237, 382, 166/75.14, 98, 117.5, 117.6

(56) References Cited

U.S. PATENT DOCUMENTS 4,898,243 A * 2/1990 Lindsey et al. ..... 166/290
4,914,637 A * 4/1990 Goodsman ..... 367/83
5,074,362 A * 12/1991 Allwin ..... 166/382
5,156,207 A * 10/1992 Haugen et al. ..... 166/142
5,224,547 A * 7/1993 Burns et al. ..... 166/301
5,617,918 A * 4/1997 Cooksey et al. ..... 166/115
6,622,803 B2 9/2003 Harvey et al. ..... 175/325.3
2002/0056574 A1 5/2002 Harvey et al. ..... 175/320

FOREIGN PATENT DOCUMENTS

WO WO 01/71149 A2 9/2001

* cited by examiner

*Primary Examiner*—Frank Tsay
(74) *Attorney, Agent, or Firm*—Woodcock Washburn LLP

(57) ABSTRACT

A latching system for maintaining the position of a component within a downhole drill string section during operation of a drill string. One preferred latching system embodiment has a shoe member including a cavity for receiving a component, a chamber opening into the shoe member cavity, an engagement member movable in the chamber between a retracted position and an engagement position, a first passage in fluid communication with the chamber and extending to an end surface of the shoe member, and a second passage extending from an outer side surface of the shoe member to the first passage. A pressure differential between pressure in the first passage and pressure in the second passage alters the position of the engagement member.

34 Claims, 8 Drawing Sheets

LATCHING SYSTEM FOR MAINTAINING POSITION OF COMPONENT WITHIN A DOWNHOLE DRILL STRING SECTION

FIELD OF THE INVENTION

The present invention is directed to a latching system for maintaining the position of a mechanical and/or electrical component within a downhole drill string section during operation of the drill string. The present invention is also directed to methods of operating drill strings that provide positive engagement of a component during operation, and disengagement and retrieval of the component upon stopping the operation.

BACKGROUND OF THE INVENTION

In underground drilling, such as gas, oil or geothermal drilling, a bore hole is drilled through a formation in the earth. Bore holes are formed by connecting a drill bit to sections of long pipe so as to form an assembly commonly referred to as a "drill string" that extends from the surface to the bottom of the bore. The drill bit is rotated so that it advances into the earth, thereby forming the bore. A high pressure drilling fluid, typically referred to as "drilling mud" is pumped down through the drill string to the drill bit so as to lubricate the drill bit and to flush cuttings from its path. The drilling fluid then flows to the surface through the annular passage formed between the drill string and the surface of the bore hole.

Downhole measuring and communication systems frequently referred to as measurement-while-drilling ("MWD") and logging-while drilling ("LWD") are typically disposed within drill string sections above and in close proximity to the drill bit. The systems comprise sensors for collecting downhole parameters, such as parameters concerning the drilling assembly itself, the drilling fluid, and those of formations surrounding the drilling assembly. For example, sensors may be employed to measure the location and orientation of the drill bit, and to detect buried utilities and other objects—critical information in the underground utility construction industry. Sensors may be provided to determine the density, viscosity, flow rate, pressure and temperature of the drilling fluid. Other sensors are used to determine the electrical, mechanical, acoustic and nuclear properties of the subsurface formations being drilled. Chemical detection sensors may be employed for detecting the presence of gas. These measuring and communication systems may further comprise power supplies and microprocessors that are capable of manipulating raw data measured by the various sensors. Information collected by sensors may be stored for later retrieval, transmitted to the earth's surface via telemetry while drilling, or both. Transmitted information provides the bases for adjusting the drilling fluid properties and/or drilling operation variables, such as drill bit speed and direction.

A mule shoe mounted within a drill string section may be used as a seat for components associated with MWD/LWD systems. Although the mule shoe helps to positively secure seated components in both a radial direction and a circumferential direction, gravity and drilling fluid are the only forces acting on the components to maintain their axial (or vertical) position. Movement of a MWD/LWD component in the vertical direction is desired such that the component can be retrieved from a downhole position, in the event of failure for example, without having to retract the entire drill string section from the bore hole.

Vertical movement of a MWD/LWD component is not however without several disadvantages. First, as the drill bit cuts through the earth, vibrations occur and are transmitted along the drilling string. These vibrations may cause fatigue, deterioration, and finally failure of the components. Second, vertical movement of the component within a mule shoe may produce undesirable wear. Third, important positional data of the drill bit and other drill string components can be comprised with a moving reference point accompanying a MWD/LWD component.

Accordingly, there is room for improvement in the art.

SUMMARY OF THE INVENTION

The present invention provides drill sting section assemblies comprising a latching system for securing a component therein. In accordance with one preferred embodiment of the present invention, there has now been provided a drill string section assembly comprising a drill pipe including a channel through which a drilling fluid flows, a component disposed in the drill pipe channel, a means for engaging the component to restrain axial and circumferential movement of the component within the drill pipe channel, and a means for disengaging the component.

In accordance with another preferred embodiment of the present invention, there has now been provided a drill string section assembly comprising a drill pipe including an inner surface, an outer surface, and a channel through which a drilling fluid flows; a shoe member disposed within the drill pipe; a component disposed within a cavity of the shoe member; and a latching system for securing the component. The latching system includes a chamber, an engagement member disposed in the chamber and movable between a biased retracted position and an engagement position, and a means for pressurizing the chamber to drive the engagement member from the biased retracted position to the engagement position.

In accordance with another preferred embodiment of the present invention, there has now been provided a drill string section assembly comprising a drill pipe including a channel through which a drilling fluid flows, a shoe member disposed within the drill pipe, and a latching system for securing a component within the shoe member. The latching system includes an engagement member movable between a retracted position and an engagement position, a first passage disposed within the shoe member and in fluid communication with the drill pipe channel, and a second passage extending from an exterior of the drill pipe to the first passage, and a piston for driving the engagement member. The piston includes a first surface subject to pressure in the first passage and an opposing surface subject to pressure in the second passage.

In accordance with yet another preferred embodiment of the present invention, there has now been provided a drill string section assembly comprising a drill pipe including a channel through which a drilling fluid flows and a shoe member disposed within the drill pipe. The shoe member includes a body including a seat portion, and a two or more legs extending from the body. A discrete latching system is disposed within each of the two or more legs for securing a component to the seat portion. Each of the latching systems includes an engagement member that is actuated by the flow of drilling fluid through the drill pipe channel.

The present invention also provides latching systems for maintaining the position of a component within a downhole drill sting section during operation of the drill string. In accordance with one preferred embodiment of the present invention, there has now been provided a latching system comprising a shoe member adapted for disposition within a drill string section and that includes a cavity for receiving a component, a chamber opening into the shoe member cavity, an engagement member movable in the chamber between a retracted position and an engagement position, a first passage in fluid communication with the chamber and extending to an end surface of the shoe member, and a second passage extending from an outer side surface of the shoe member to the first passage. A pressure differential between pressure in the first passage and pressure in the second passage alters the position of the engagement member.

In accordance with another preferred embodiment of the present invention, there has now been provided a latching system comprising a shoe member adapted for disposition within a drill string section. The shoe member has an annular body defining a cavity therein, and two or more legs extending radially from the annular body. Each of the legs includes an engagement member for securing a component within the cavity and a passage for communicating pressure from drilling fluid, when pumped through the drill pipe channel, to the engagement member.

Lastly, the present invention provides methods of operating a drill string, a section of which includes a component and a latching system for securing the component. In accordance with one preferred embodiment of the present invention, there has now been provided a method comprising the steps of inserting the drill string into a hole, restraining the component from axial and circumferential motion within the drill string by pumping drilling fluid through the drill string whereby pressure from the drilling fluid activates the latching system, deactivating the latching system by stopping the pumping of the drilling fluid, and retrieving the component from a downhole position without retracting the drill string from the hole.

BRIEF DESCRIPTION OF THE DRAWINGS

The present invention is believed to be best understood through the following detailed description of the preferred embodiments and the accompanying drawings wherein like reference numerals indicate like features, and wherein.

DETAILED DESCRIPTION OF ILLUSTRATIVE EMBODIMENTS

Figure 1:
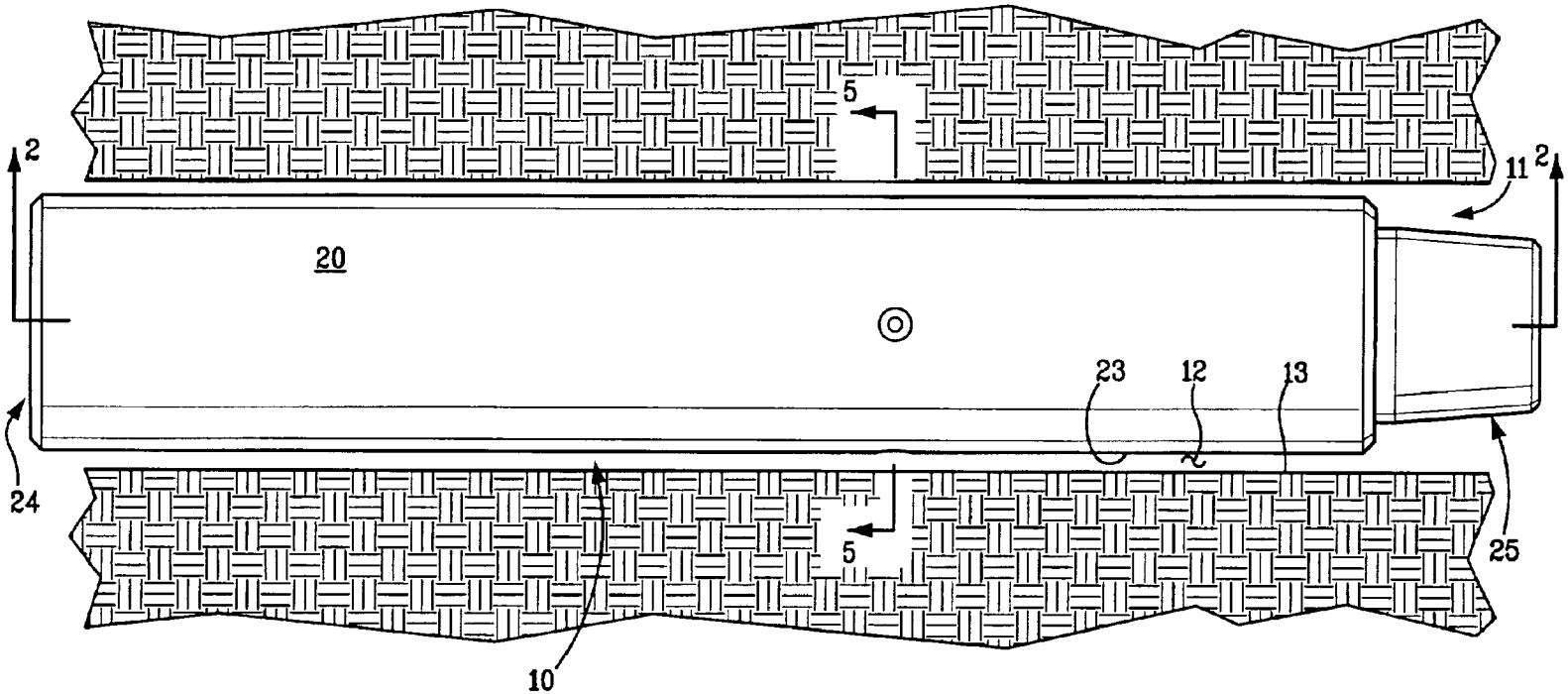
FIG. 1 is an elevation view of a drill string section positioned within an earthen bore hole.
Figure 2:
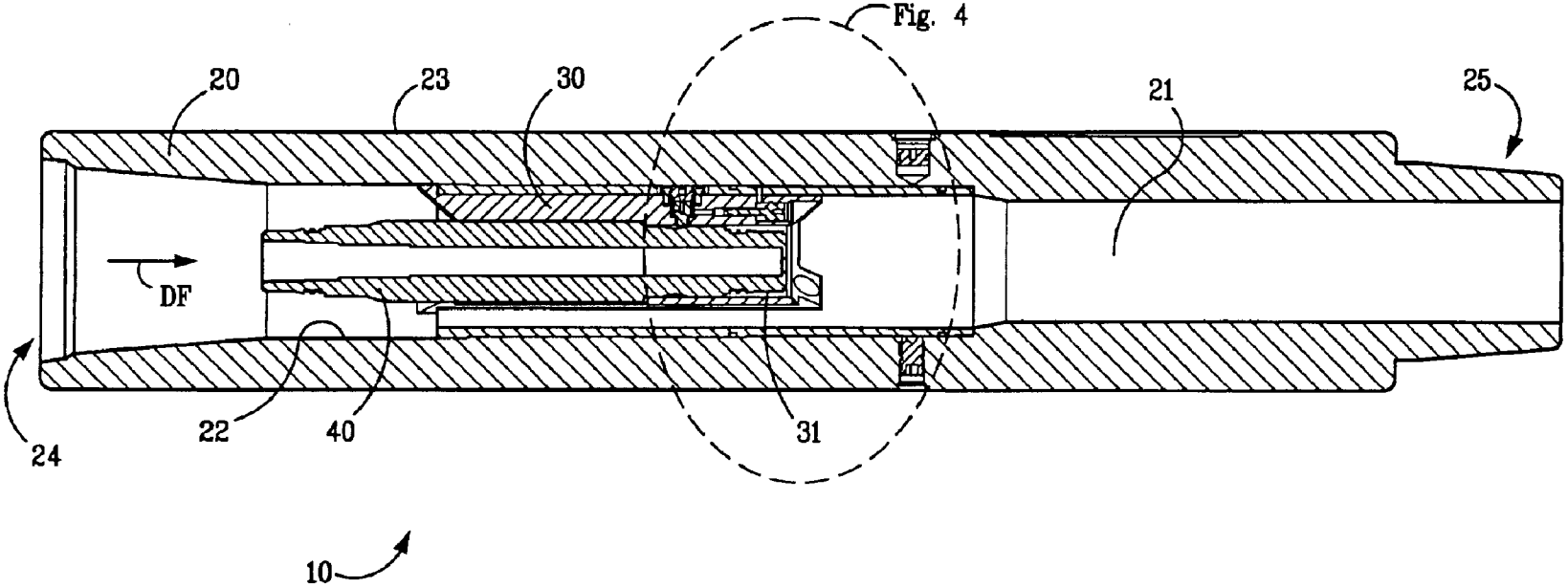
FIG. 2 is a longitudinal cross-sectional view of the drill sting section shown in FIG. 1 taken through line 2—2, showing a component secured therein through the use of a latching system in accordance with a preferred embodiment of the current invention.

Referring now to the drawings, wherein like reference numerals designate corresponding structure throughout the views, and referring in particular to FIGS. 1 and 2, a drill string section 10 is shown including a drill pipe 20 having a channel 21 through which drilling fluid is pumped in direction DF, an inner surface 22, and outer surface 23. As can be seen in the figures, end portions 24 and 25 may be configured such that multiple drill string sections can be coupled to one another to form a drill string without a substantial amount of extra hardware, for example, by employing mating threaded regions on end portions 24 and 25. Channel 21 is illustrated with portions of varying diameter. Drill string sections contemplated by the present invention may alternatively have channels of a uniform diameter. In FIG. 1, drill string section 10 is shown positioned within a bore hole 11. Drilling fluid that is pumped through and exits the end of a drill string employing section 10 returns to the surface through annular passage 12, which is formed between the outer surface 23 of drill string section 10 and bore hole surface 13.

Referring to FIG. 2, a shoe member 30 is positioned within channel 21 for receiving a mechanical and/or electrical component (preferably corresponding to data acquisition), such as, for example, those associated with measurement-while-drilling (MWD) and logging-while-drilling (LWD) systems. By way of example, a component in the form of a stinger 40 is seated within cavity 31 of the shoe member. A latching system in accordance with a preferred embodiment of the current invention is utilized to maintain the axial and circumferential positions of stinger 40 during operation of a drill sting employing drill string section 10. Drill string sections having MWD/LWD systems are generally located near a drill bit on the end of the drill string. In the event of a downhole failure of a component (or system associated with the component), the latching system can be deactivated to allow the component to be pulled out the bore hole without retracting the entire drill string.

Figure 3:
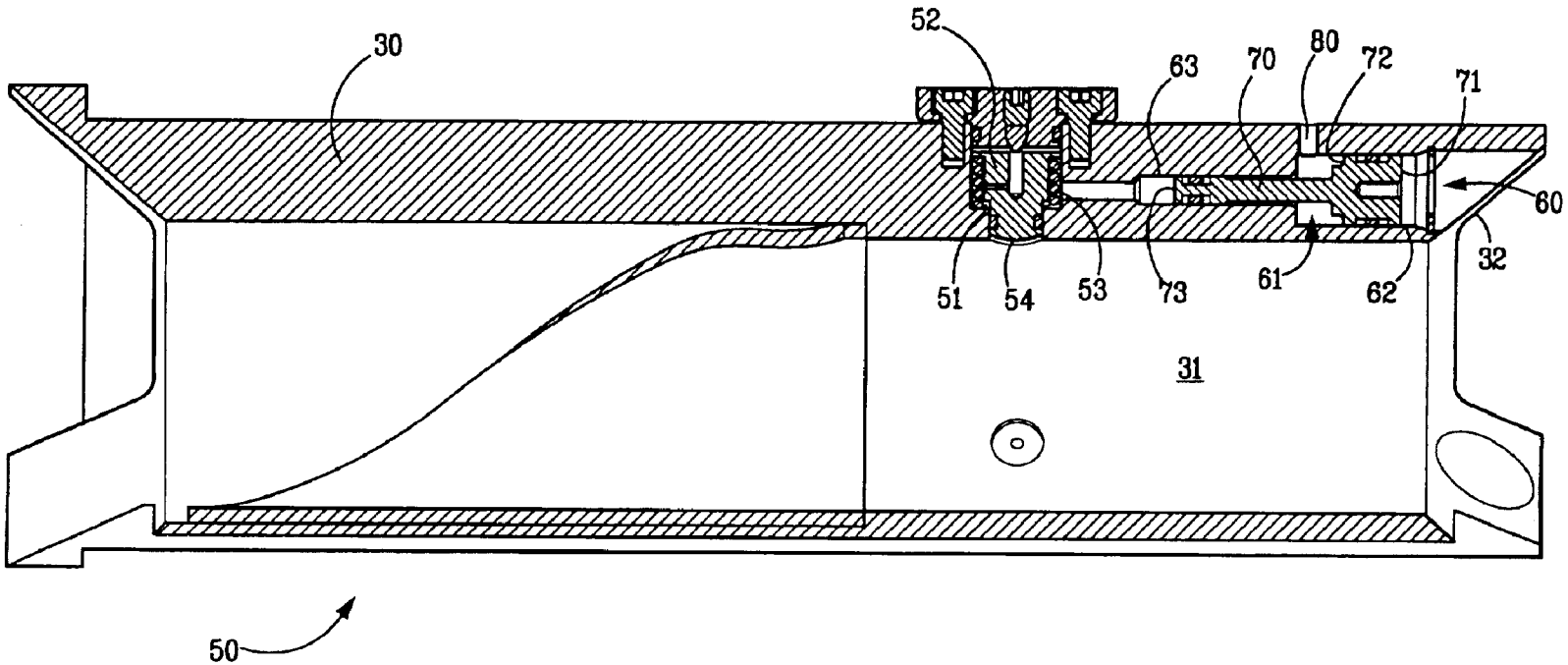
FIG. 3 is a longitudinal cross-sectional view of the preferred latching system embodiment shown in FIG. 2.

Referring now to FIG. 3, a first preferred latching system 50 is shown including shoe member 30, a chamber 51, and an engagement member 52 that is movably disposed within chamber 51. Optional spring 53 biases engagement member 52 in a retracted position. As discussed below, chamber 51 is pressurized to drive engagement member 52 from the retracted position to an engagement position (shown in FIG. 6 with the use of a broken line labeled EP for engagement position). At the engagement position, a portion of engagement member 52 extends into the shoe member cavity 31 such that an engaging surface 54 can contact a component seated therein. Engaging surface 54 is preferably tapered, convex, or otherwise shaped to aid in both alignment of a component when engaging the same, and in retrieval of the component. As shown in FIG. 3, engaging surface 54 is convex.

A passage 60 is illustrated in FIG. 3 extending from a shoe member end surface 32 to chamber 51. Passage 60 serves to communicate pressure to chamber 51. In a preferred embodiment, passage 60 includes a stepped piston bore 61 having a large diameter bore 62 and a small diameter bore 63. An intensifier piston 70 is disposed within stepped piston bore 61. Intensifier piston 70 increases pressure acting on its surface 71 that is introduced into passage 60, and communicates the increased pressure to chamber 51. In this configuration, stepped piston bore 61 and chamber 51 are filled with a hydraulic fluid, such as oil. Alternative embodiments contemplated by the present invention do not employ a stepped piston bore or an intensifier piston.

Another passage 80 is shown in FIG. 3 extending from a shoe member outer side surface 33 to passage 60. Pressure within passage 80 acts on surface 72 of the intensifier piston. When pressure within passage 60 is greater than pressure within passage 80, intensifier piston 70 travels toward chamber 51 to pressurize the same. Once the increased pressure within chamber 51 is sufficient to overcome the spring force associated with spring 53, engagement member 52 moves from the retracted position to the engagement position. When pressure within passage 60 (including pressure within large diameter bore 62 and small diameter bore 63) and pressure within passage 80 equalize, intensifier piston 70 does not communicate increased pressure to chamber 51, and thus, spring 53 returns engagement member 52 to a retracted position. Accordingly, a pressure differential between pressure in passage 60 and pressure in passage 80 alters the position of intensifier piston 70, and therefore dictates whether or not increased pressure is communicated to chamber 51. Employment of the intensifier piston 70 permits the use of a spring 53 having a high spring force, which in turn, increases the reliability that engagement member 52 returns to a retracted position. That is, the intensifier piston is acted upon by a first pressure, which is then increased substantially such that spring 53 can be compressed and the engagement member 52 driven to the engagement position.

Figure 4:
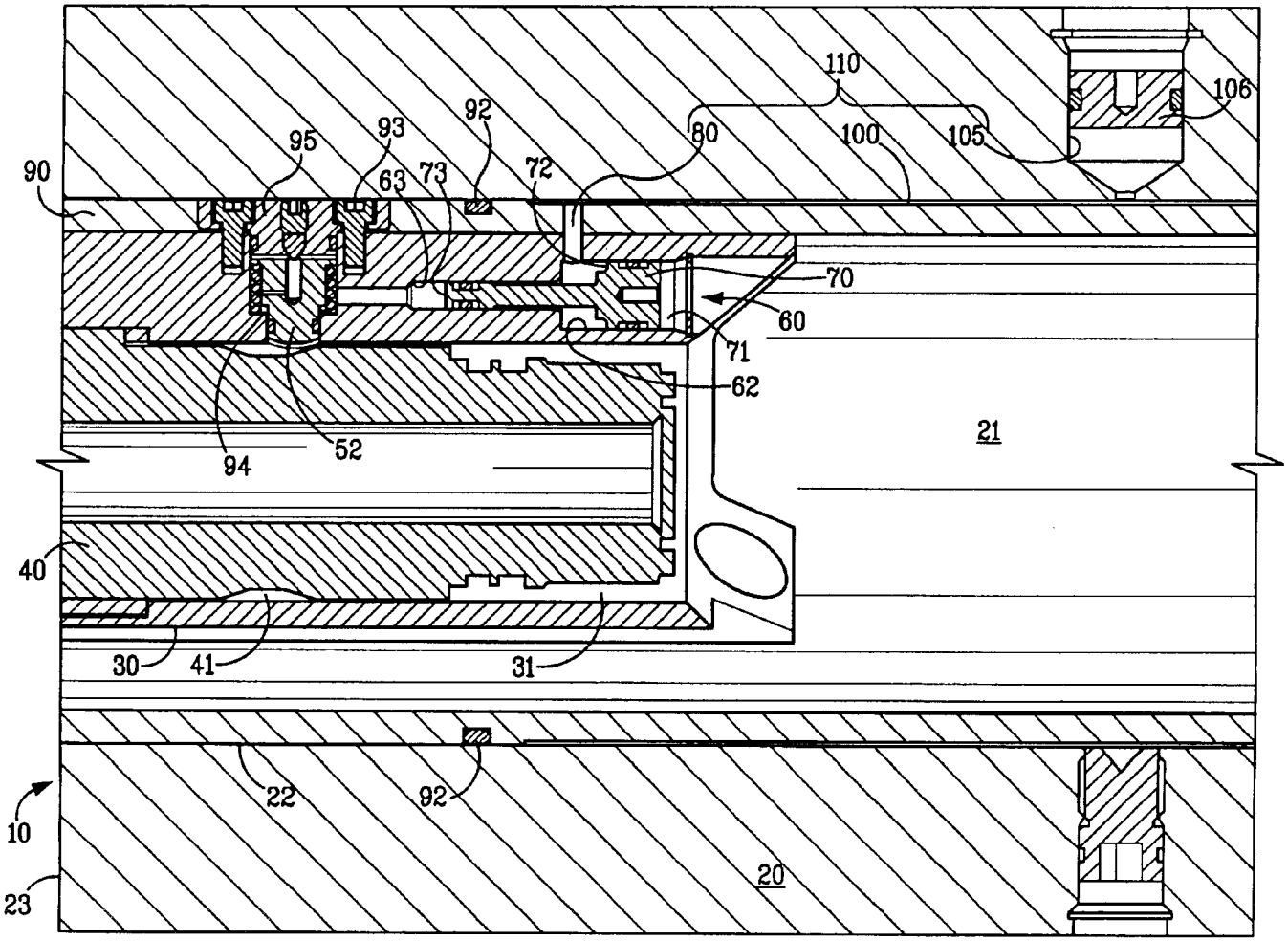
FIG. 4 is a partial and enlarged view of the drill string section embodiment shown bounded by the broken line in FIG. 2.
Figure 5:
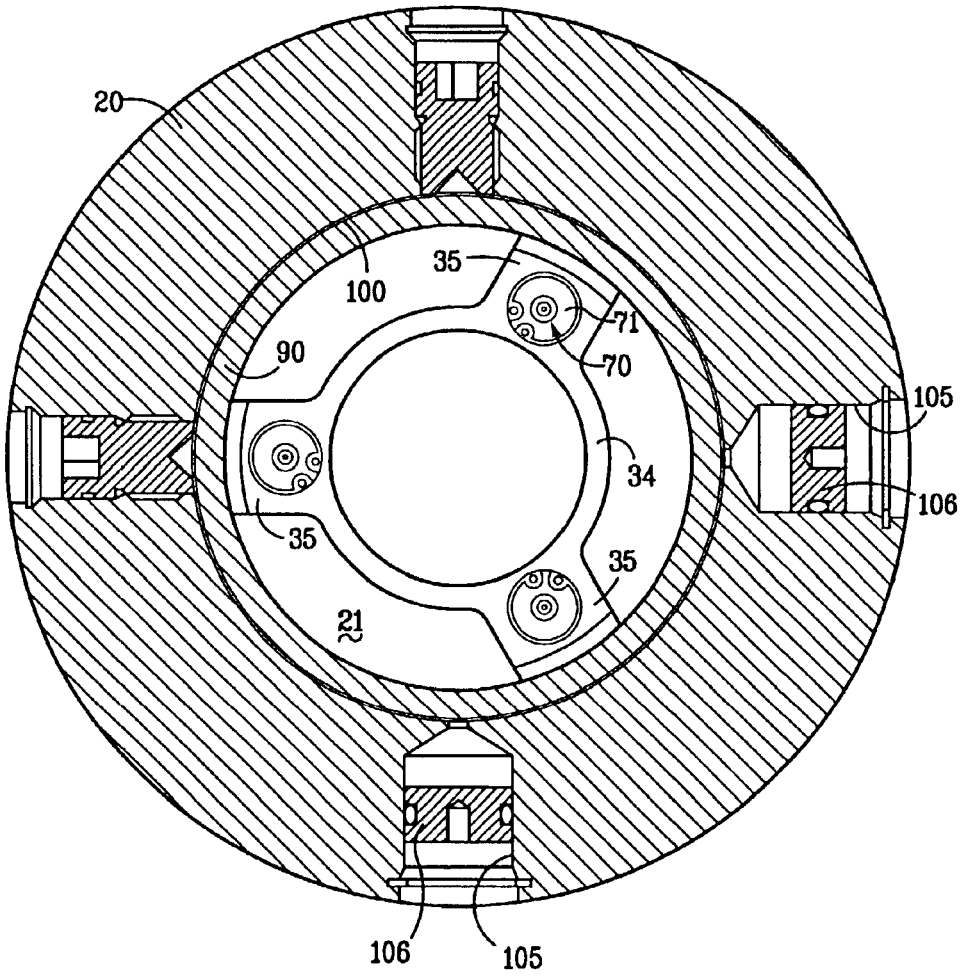
FIG. 5 is a transverse cross-sectional view of the drill string section shown in FIG. 1 taken through line 5—5.

In FIGS. 4 and 5, the preferred latching system 50 discussed above with reference to FIG. 3 is shown positioned within drill sting section 10. Shoe member 30 is rigidly coupled to a sleeve member 90 with a series of screws 93. Sleeve member 90 is placed within drill pipe channel 21 and secured to the drill pipe inner surface 22 by o-rings 92.

A fluid reservoir 100 filled with a hydraulic fluid is defined by a gap created between a portion of sleeve member 90 and the drill pipe inner surface 22. A piston bore 105 extends from the drill pipe outer surface 23 to an inner surface 22 section that is in fluid communication with fluid reservoir 100. Fluid reservoir 100 is also in fluid communication with passage 80. Thus, passage 80, fluid reservoir 100 and piston bore 105 collectively define a passage 110 that extends from the exterior of the drill pipe to passage 60. Internal and external pressures are exerted on the drill string when positioned within a bore hole. As will be discussed next, pressure introduced into passage 60 represents internal pressure in the drill pipe channel 21 (that is, drilling fluid pressure within channel 21), and pressure communicated through passage 110 represents annulus pressure (pressure of drilling fluid in annular passage 12, as shown in FIG. 1, that is returning to the surface and is applied to the exterior of the drill string section 10).

The preferred latching system 50 illustrated in FIGS. 3–5 operates on the differential pressure between the internal pressure and the annulus pressure created when drilling fluid is pumped through the dill string section. A pressure drop occurs across a distally located drill bit as drilling fluid exits the drill string and begins to move back to the surface in the annular space between the hole being drilled and the drill string. Therefore, the internal pressure within the drill pipe channel 21 will be greater than the annulus pressure surrounding drill string section 10. The pressure differential is typically at least about 200 PSI However, if a mud motor is employed in the drill string, the pressure differential could be significantly higher. Internal pressure from flowing drilling fluid is introduced into passage 60, and annulus pressure of the exited and returning drilling fluid is communicated through passage 110 via a compensator piston 106 disposed in piston bore 105. The internal pressure, being greater than the annulus pressure, acts on intensifier piston surface 71 to move intensifier piston 70 towards chamber 51 to pressurize the same. The increased pressure applied to chamber 51 is sufficient to compress spring 53 and to drive engagement member 52 into the engagement position so that engagement surface 54 extends into component notch 41. Accordingly, when drilling fluid is pumped through the drill string section, a component seated within shoe member 30 will be secured by engagement member 52.

When drilling fluid pumps are stopped, the internal pressure and annulus pressure equalize. That is, the pressure in passage 60 acting on intensifier piston surfaces 71 and 73 (resulting from the internal pressure), and the pressure in passage 80 acting on intensifier piston surface 72 (resulting from the annulus pressure) equalize, resulting in a zero net force acting on intensifier piston 70. Potential energy from the compressed spring 53 then drives the engagement member from the engagement position back to a retracted position. Since the engagement member 52 is no longer contacting the component seated within shoe member 30, the component is retrievable from a downhole location. Note, stiction may occur in the latching system such that engagement member 52 is prevented from fully retracting when the drilling fluid pumps are stopped and the internal pressure and annulus pressure substantially equalize (i.e., the spring 53 potential energy may not be adequate to drive the engagement member completely back into a retracted position). Here, an external retrieval force applied to the component, in conjunction with a shaped component notch 41 (corresponding engaging surface 54 may or may not also be shaped), will drive the engagement member 52 away from the engagement position sufficiently to allow the component to be retrieved from its downhole location.

By way of example, a latching system similar to that shown in FIGS. 3–5 has a stepped piston bore including a large diameter portion of 0.499" and a small diameter portion of 0.200", and an intensifier piston movably disposed in the stepped piston bore. With a differential pressure of 200 PSI (i.e., 200 PSI higher within the drill string channel) acting on the intensifier piston, an actuation pressure of 1,045 PSI is created. The engagement member has the same differential pressure of 200 PSI acting on its engaging surface, therefore, the resulting pressure for driving the engagement member is 845 PSI The resulting pressure of 845 PSI is applied to the engagement member having a diameter of 0.373" to yield a driving force of 92 lbs. In a compressed state, a spring biasing the engagement member in a retracted position provides an opposite acting force of 20 lbs., leaving 72 lbs force to hold the component within a shoe member.

With reference to FIG. 5, shoe member 30 preferably includes an annular body 34 that defines cavity 31 (a "seat portion"), and a plurality of legs 35 radially extending from body 34. Each of legs 35 are shown with a passage 60 and an intensifier piston 70, which drives individual engagement members. That is, each of legs 35 employ discrete latching systems. In this configuration, the securing force on a component is multiplied by the number of latching systems employed. Multiple discrete latching systems also provides a safety feature, whereby a component is still effectively secured even though one of the latching systems fails to operate properly. In alternative embodiments contemplated by the present invention (not shown), shoe members may have only a single leg, or a plurality of legs wherein less than all of the plurality of legs employ an independent latching system. Although FIG. 5 illustrates portions of preferred latching system embodiment 50, alternative latching systems may be employed in conjunction with a shoe member having a central body and radially extending legs.

Figure 6:
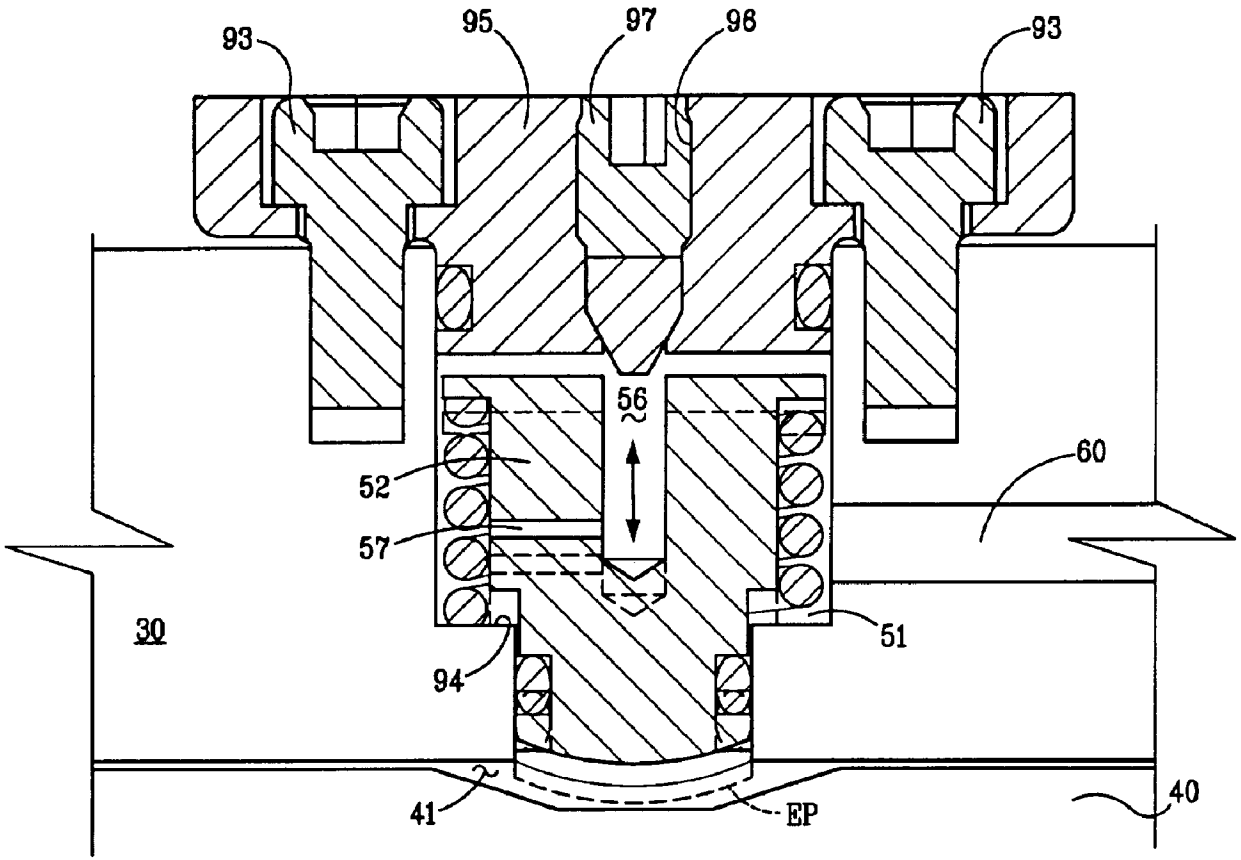
FIG. 6 is a partial cross-sectional view illustrating a latching system engagement member in both a retracted position and an engagement position (shown with broken line)

Referring now to FIG. 6, engagement member 52 is shown in a retracted position via solid lines and in an engagement position EP via broken lines. Travel of engagement member 52 within chamber 51 is limited in one direction by a shoulder 94 and in the opposite direction by a cover 95. Assembly generally includes installing engagement member 52 and spring 53 within chamber 51, placing cover 95 over chamber 51 with screws 93, filling chamber 51 with hydraulic fluid through passage 96 in cover 95 and passages 56 and 57 in engagement member 52, and then sealing passage 96 with screw 97.

Figure 7:
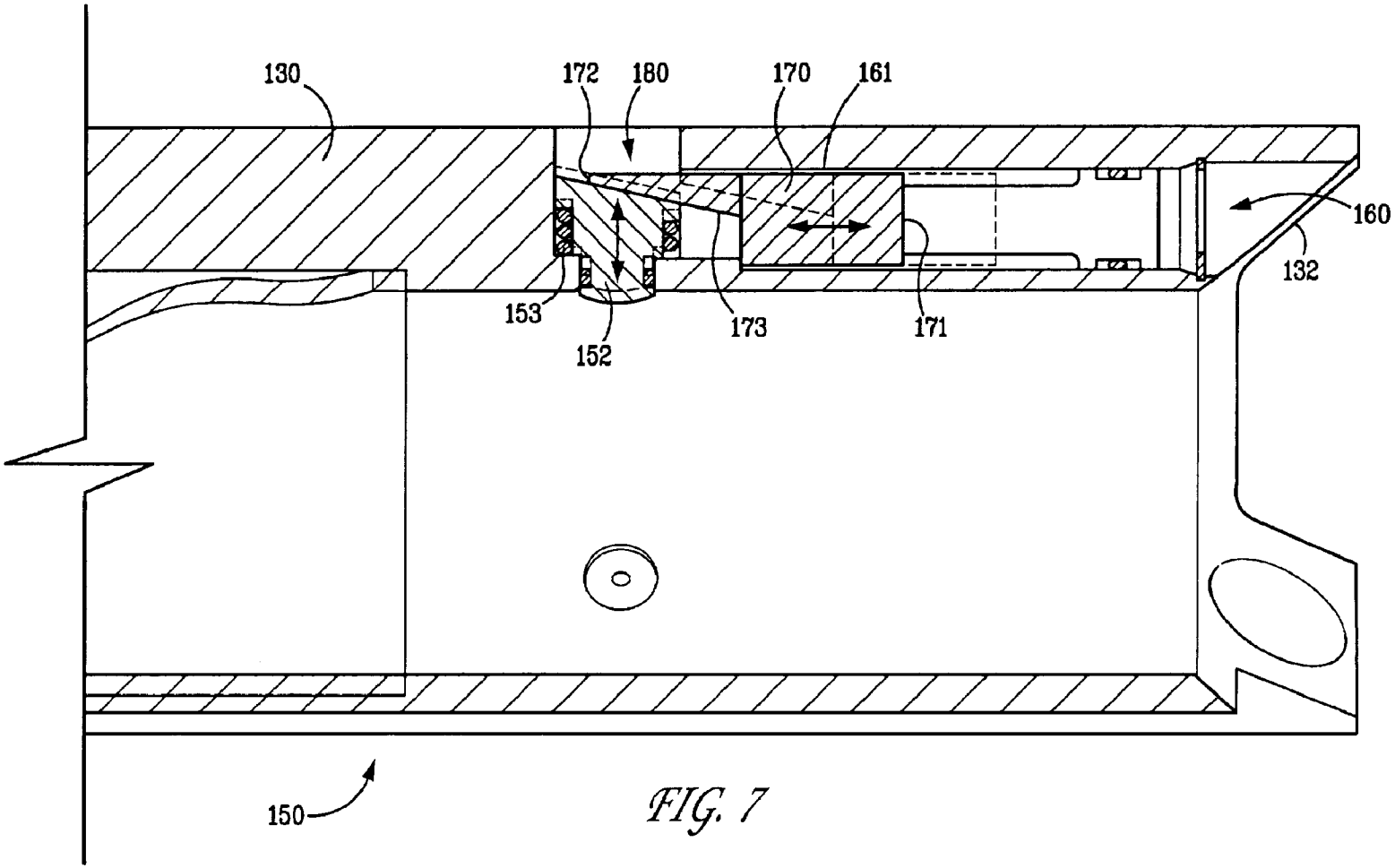
FIG. 7 is a partial longitudinal cross-sectional view of another preferred latching system embodiment.

A second preferred latching system 150 is shown in FIG. 7, including a shoe member 130 having a first passage 160 extending to an end surface 132 thereof, and a second passage 180 extending from an outer side surface of shoe member 130 to first passage 160. The second preferred latching system similarly operates on the differential pressure between the internal pressure and the annulus pressure created when drilling fluid pumped through the drill string section. Internal pressure is communicated via first passage 160 and annulus pressure is communicated via second passage 180. First passage 160 includes a piston bore 161 for receiving a piston 170. Piston 170 has a first surface 171 and an opposing second surface 172. Piston 170 employs an inclined plane surface 173 for engaging an engagement member 152, such that when a pressure differential exists, piston 170 moves toward engagement 152 and the inclined plane surface 173 mechanically drives engagement member 152 from a retracted position to an engagement position. When a pressure differential ceases to exists, spring 153 can help return engagement member 152 to the retracted position.

Figure 8:
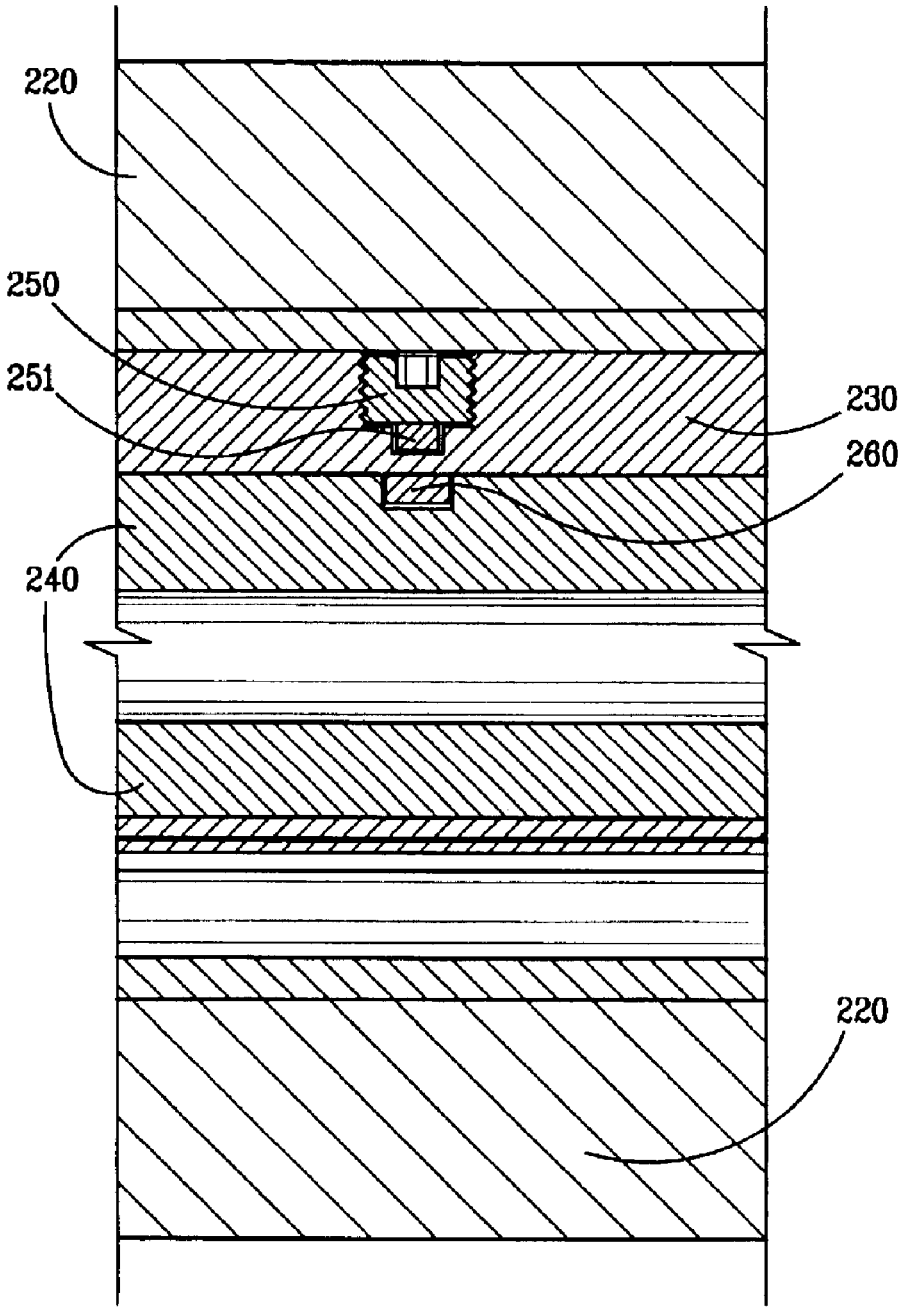
FIG. 8 is a partial cross-sectional view illustrating a drill string section including a shoe member and a component seated within the mule shoe, the mule shoe has a means for determining the positioning of the component within the mule shoe.

Preferred latching systems in accordance with the present invention are intended to secure a MWD/LWD component once it is seated within a shoe member. Means for ensuring that the component is initially properly seated within shoe member may optionally be employed (that is, a means for indicating/determining the axial and/or circumferential positioning of the component with in the shoe member). By way of example and with reference to FIG. 8, a shoe member 230 is disposed within a drill string section 220, and a component 240 is seated within shoe member 230. A threaded plug 250 having a magnetic slug 251 is disposed within shoe member 230. Component 240 includes a sensor 260, such as, for example, a Hall effect sensor, that will react to the presence of a magnetic field. Sensor 260 may employ a switch that is normally in a biased open or closed position, and when component 240 is properly seated within shoe member 230, the relative positions of the magnetic slug 251 and the sensor 260 will cause a change in the biased (open or closed) switch position, thus indicating proper alignment of component 240. If component 240 is not properly seated within shoe member 230, then the switch position will accordingly not be altered, and adjustments or re-seating of component 240 can follow. Other means may also be employed in the component and/or shoe member to indicate initial alignment of a seated component.

A preferred method of operating a drill string, a section of which includes a component and a latching system for securing the component in the section, is provided including the steps of inserting the drill string into a hole; restraining the component within the drill string by pumping drilling fluid through the drill string, whereby pressure from the drilling fluid activates the latching system; deactivating the latching system by stopping the pumping of the drilling fluid; and retrieving the component from a downhole position without retracting the drill string from the hole. While the discussion has focused on the drill string section and latching system features illustrated in FIGS. 1–8, the preceding method is contemplated to encompass alternative drill string section and latching system embodiments.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed is:

1. A drill string section assembly comprising:

a) a drill pipe including a channel through which a drilling fluid flows;

b) a component disposed within the drill pipe channel;

c) a means for engaging the component such that the component is restrained from upward and downward axial movement and circumferential movement when drilling fluid flows through the drill pipe channel; and d) a means for disengaging the component such that the component can be separated from the drill pipe.

2. The drill string section assembly of claim 1, wherein the means for engaging the component includes an engagement member that is movable from a retracted position to an engagement position by the flow of drilling fluid through the drill pipe channel.

3. The drill string section assembly of claim 1, further comprising a means for indicating component position within the drill pipe channel.

4. A drill string section assembly comprising:

a) a drill pipe including an inner surface, an outer surface, and a channel through which a drilling fluid flows;

b) a shoe member disposed within the drill pipe, the shoe member including a cavity;

c) a component disposed within the cavity; and d) a latching system positioned within the shoe member for securing the component within the shoe member cavity; the latching system comprising:

i. a chamber;

ii. an engagement member movably disposed within the chamber, the engagement member movable between a biased retracted position and an engagement position, at which engagement position a portion of the engagement member extends into the shoe member cavity and engages the component; and iii. a means for pressurizing the chamber to drive the engagement member from the biased retracted position to the engagement position.

5. The drill string section assembly of claim 4, wherein the means for pressuring the chamber includes a stepped piston bore disposed in the shoe member that is in fluid communication with the drill pipe channel and in fluid communication with the chamber; and an intensifier piston movably disposed in the stepped piston bore for increasing pressure applied by drilling fluid pumped through the drill pipe channel and communicating the increased pressure to the chamber.

6. The drill string section assembly of claim 5, further comprising a sleeve interposed between the shoe member and the drill pipe inner surface; and a fluid reservoir between a portion of the sleeve and the drill pipe inner surface, the fluid reservoir being in fluid communication with the stepped piston bore.

7. The drill string section assembly of claim 6, wherein the drill pipe includes a piston bore extending from the outer surface to the inner surface that is in fluid communication with the reservoir, and wherein a piston movably disposed within the drill pipe piston bore pressurizes fluid contained within the fluid reservoir.

8. The drill string section assembly of claim 4, wherein the shoe member includes an annular body that defines the cavity, and a plurality of legs extending radially from the annular body.

9. The drill string section assembly of claim 8, wherein the latching system is disposed within one of the plurality of legs.

10. The drill string section assembly of claim 8, wherein each of the plurality of legs includes an independently-operating latching system.

11. The drill string section assembly of claim 4, wherein the component includes a notch that receives an engaging surface of the engagement member.

12. The drill string section assembly of claim 11, wherein the notch is shaped to facilitate returning the engagement member to the retracted position when an external retrieval force is applied to the component.

13. The drill string section assembly of claim 12, wherein the notch is chamfered.

14. The drill string section assembly of claim 13, wherein the engaging surface includes a corresponding chamfer.

15. The drill string section assembly of claim 4, wherein the shoe member includes a magnetic member and the component includes a sensor for sensing the presence of the magnetic member, whereby axial and/or circumferential positioning of the component within the shoe member cavity can be determined.

16. A drill string section assembly comprising:

a) a drill pipe including a channel through which a drilling fluid flows;

b) a shoe member disposed within the drill pipe, the shoe member including a cavity; and c) a latching system for securing a component within the shoe member cavity; the latching system comprising:

i. an engagement member movably disposed within the shoe member, the engagement member movable between a retracted position and an engagement position, at which engagement position a portion of the engagement member extends into the shoe member cavity;

ii. a first passage disposed within the shoe member and in fluid communication with the drill pipe channel;

iii. a second passage extending from an exterior of the drill pipe to the first passage; and iv. a piston for driving the engagement member, the piston including a first surface subject to pressure in the first passage and an opposing surface subject to pressure in the second passage.

17. The drill string section assembly of claim 16, wherein the shoe member includes an annular body that defines the cavity, and a plurality of legs extending radially from the annular body.

18. The drill string section assembly of claim 17, wherein the latching system is disposed within one of the plurality of legs.

19. The drill string section assembly of claim 17, wherein each of the plurality of legs includes an independently-operating latching system.

20. The drill string section assembly of claim 16, further comprising a component disposed within the shoe member cavity.

21. The drill string section assembly of claim 16, wherein the first passage includes a piston bore and a piston movably disposed therein, the piston including an inclined plane surface for engaging the engagement member, such that the engagement member is mechanically driven from the retracted position to the engagement position.

22. A drill string section assembly comprising:

a) a drill pipe including a channel through which a drilling fluid flows;

b) a shoe member disposed within the drill pipe, the shoe member comprising a body including a seat portion, and two or more legs extending from the body; and c) a discrete latching system disposed within each of the two or more legs for securing a component to the seat portion, each of the latching systems including an engagement member actuated by the flow of drilling fluid pumped through the drill pipe channel.

23. The drill string section assembly of claim 22, further comprising a component engaged with the shoe member seat portion.

24. A latching system for maintaining the position of a component within a downhole drill string section during operation of a drill string, the latching system comprising:

a) a shoe member adapted for disposition within a drill string section, the shoe member including a cavity for receiving a component;

b) a chamber opening into the shoe member cavity;

c) an engagement member movably disposed within the chamber, the engagement member movably between a retracted position and an engagement position, at which engagement position a portion of the engagement member extends into the shoe member cavity;

d) a first passage in fluid communication with the chamber and extending to an end surface of the shoe member; and e) a second passage extending from an outer side surface of the shoe member to the first passage;

wherein a pressure differential between pressure in the first passage and pressure in the second passage alters the position of the engagement member.

25. The latching system of claim 24, wherein the first passage includes a stepped piston bore and an intensifier piston movably disposed therein for driving the engagement member from the retracted position to the engagement position.

26. The latching system of claim 24, wherein the first passage includes a piston bore and a piston movably disposed therein, the piston including an inclined surface for engaging the engagement member, such that the engagement member is mechanically driven from the retracted position to the engagement position.

27. The latching system of claim 24, further comprising a spring for biasing the engagement member in the retracted position.

28. A latching system for maintaining the position of a component within a downhole drill string section during operation of a drill string, the latching system comprising:

a shoe member adapted for disposition within a drill string section, the shoe member comprising an annular body defining a cavity therein, and a two or more legs extending radially from the annular body;

wherein each of the two or more legs includes an engagement member for securing a component within the cavity and a passage for communicating pressure from drilling fluid, when pumped through the drill pipe channel, to the engagement member.

29. The latching system of claim 28, wherein each passage includes a stepped piston bore and an intensifier piston movably disposed therein.

30. A method of operating a drill string, a section of which includes a component and a latching system for securing the component in the section, the method comprising the steps of:

a) inserting the drill string into a hole;

b) restraining a component from axial and circumferential motion within the drill string by pumping drilling fluid through the drill string, whereby pressure from the drilling fluid activates the latching system;

c) deactivating the latching system by stopping the pumping of the drilling fluid; and d) retrieving the component from a downhole position without retracting the drill string from the hole.

31. The method of claim 26, wherein the latching system is the latching system of claim 24.

32. The method of claim 26, wherein the latching system is the latching system of claim 28.

33. A drill string section assembly comprising:

a) a drill pipe including a channel through which a drilling fluid flows;

b) a component disposed within the drill pipe channel;

c) a means for engaging the component such that the component is restrained from upward and downward axial movement and circumferential movement when drilling fluid flows through the drill pipe channel, the means for engaging the component includes an engagement member that is movable from a retracted position to engagement position by the flow of drilling fluid through the drill pipe channel; and d) a means for disengaging the component such that the component can be separated from the drill pipe.

34. The drill string section assembly of claim 33, further comprising a means for indicating component position within the drill pipe channel.

* * * * *

UNITED STATES PATENT AND TRADEMARK OFFICE

CERTIFICATE OF CORRECTION

PATENT NO. : 6,896,050 B2
DATED : May 24, 2005
INVENTOR(S) : Denis P. Biglin, Jr. et al.

It is certified that error appears in the above-identified patent and that said Letters Patent is hereby corrected as shown below:

Column 2,
Line 66, please delete “sting” and insert -- string -- therefor.

Column 3,
Line 45, please delete “sting” and insert -- string -- therefor.

Column 5,
Line 57, please delete “dill” and insert -- drill -- therefor.
Line 64, after “200 PSI” insert -- . -- therefor.

Column 6,
Line 47, after “845 PSI” insert -- . -- therefor.

Signed and Sealed this

Thirteenth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,896,050 B2
DATED : May 24, 2005
INVENTOR(S) : Denis P. Biglin, Jr. et al.

It is certified that error appears in the above-identified patent and that said Letters Patent is hereby corrected as shown below:

Title page,
Item [73], Assignee, should read -- APS -- instead of "PS".

Signed and Sealed this

Eighth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,896,050 B2
DATED : May 24, 2005
INVENTOR(S) : Denis P. Biglin, Jr. et al.

It is certified that error appears in the above-identified patent and that said Letters Patent is hereby corrected as shown below:

Title page,
Item [73], Assignee, please delete "PS Technology, Inc.," and insert -- APS Technology, Inc., -- therefor.

Signed and Sealed this

Twenty-second Day of November, 2005

JON W. DUDAS
*Director of the United States Patent and Trademark Office*